US009394749B2

(12) United States Patent
Strange

(10) Patent No.: US 9,394,749 B2
(45) **Date of Patent: *Jul. 19, 2016**

(54) MULTI-RAM DRILL RIG AND METHOD OF OPERATION

(71) Applicant: STRADA DESIGN LIMITED, St Helier, Jersey (GB)

(72) Inventor: Warren Strange, Bicton (AU)

(73) Assignee: STRADA DESIGN LIMITED, St Helier, Jersey (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/677,096

(22) Filed: Apr. 2, 2015

(65) Prior Publication Data

US 2015/0275593 A1 Oct. 1, 2015

Related U.S. Application Data

(63) Continuation of application No. 13/257,672, filed as application No. PCT/AU2010/000323 on Mar. 19, 2010, now Pat. No. 8,997,893.

(30) Foreign Application Priority Data

Mar. 20, 2009 (AU) ..... 2009201127

(51) Int. Cl.
*E21B 7/00* (2006.01)
*E21B 1/00* (2006.01)
*E21B 19/08* (2006.01)
(Continued)

(52) U.S. Cl.
CPC ..... *E21B 19/08* (2013.01); *E21B 19/02* (2013.01); *E21B 19/084* (2013.01); *E21B 19/086* (2013.01)

(58) Field of Classification Search
CPC ..... E21B 19/084; E21B 19/086; E21B 19/08; E21B 19/02
See application file for complete search history.

(56) References Cited

U.S. PATENT DOCUMENTS 3,659,655 A 5/1972 Gyongyosi
3,692,123 A 9/1972 Gyongyosi
(Continued)

FOREIGN PATENT DOCUMENTS

DE 1020060 34 890 A1 2/2008
WO WO-99/43920 A1 9/1999

OTHER PUBLICATIONS

Supplementary European Search Report dated Aug. 7, 2015, in corresponding European application No. 10 75 3009.9, 6 pages.
(Continued)

*Primary Examiner* — Michael Wills, III
(74) *Attorney, Agent, or Firm* — Foley & Lardner LLP

(57) ABSTRACT

A drill rig 10 comprises a tower 12 and a drill head 14 that is able to travel linearly up and down the tower 12. The drill head 14 provides torque to a drill string 16 attached to the drill head 14 ad thus to a drill bit 18 coupled to a distal end of the drill string 16. The drill head 14 is traversed along the tower 12 by a plurality of rams 22*a*, 22*b* and 22*c* (hereinafter referred to in general as "rams 22"). The rams 22 provided hold back and pull down for the drill bit 18 via the drill head 14. The rams 22 are selectively operable to enable the hold back and pull down applied to the drill bit to be selectively varied. Thus for example a first of the rams 22*a* is selected to operate when drilling to a first depth, then the rams 22*b* and 22*c* are selected to operate when drilling to a second greater depth; and finally all three rams 22*a*, 22*b* and 22*c* are selected to operate when drilling to a third greater depth.

20 Claims, 5 Drawing Sheets

(51) Int. Cl.

| | |
|---|---|
| ***E21B 19/02*** | (2006.01) |
| ***E21B 19/084*** | (2006.01) |
| ***E21B 19/086*** | (2006.01) |

(56) References Cited

U.S. PATENT DOCUMENTS

| | | | |
|---|---|---|---|
| 4,027,854 | A | 6/1977 | Mounton, Jr. |
| 4,128,229 | A | 12/1978 | Elliston |
| 4,170,340 | A | 10/1979 | Mouton, Jr. |
| 4,341,373 | A | 7/1982 | Mouton, Jr. |
| 4,585,213 | A | 4/1986 | Slagle et al. |
| 6,926,103 | B1 | 8/2005 | Roodenburg et al. |
| 8,491,013 | B2 | 7/2013 | Peer et al. |
| 2001/0025727 | A1 | 10/2001 | Byrt et al. |

OTHER PUBLICATIONS

International Search Report in PCT/AU2010/000323 dated May 6, 2010, 3 pages.

MULTI-RAM DRILL RIG AND METHOD OF OPERATION

CROSS-REFERENCE TO RELATED APPLICATIONS

This application is a Continuation of U.S. application Ser. No. 13/257,672, filed Apr. 7, 2015, which is the U.S. National Stage of PCT/AU2010/000323, filed Mar. 19, 2010, which claims priority from Australian Application No. 2009201127, filed Mar. 20, 2009.

FIELD OF THE INVENTION

The present invention relates to a multi-ram drill rig and a method of operating such a drill rig.

BACKGROUND OF THE INVENTION

A typical drill rig comprises a tower which supports a drill head that in turn rotates a drill string. The drill head can be slid up and down the tower for the purposes of tripping a drill into and out of a hole. The motion of the drill head is controlled by one or more hydraulic rams. The size of the rams used is dependent upon the maximum drilling depth of the drill rig. For relatively shallow holes for example up to 800 m, a drill rig may comprise two rams each having 120 mm (approximate 5") diameter. Such a drill rig may require a power pack providing approximately 400 hp and consume in the order of 960 L of fuel per day. In comparison, a drill rig designed to drill to a depth of say 2000 m may incorporate two rams each of 300 mm (12") and require a 2500 hp power pack and consuming approximately 8400 L of fuel per day. The reason that larger rams are required to drill deeper holes is to ensure that the drill rig can apply the required hold back as the weight of the drill string increases with increasing hole depth enabling control the effective weight applied by the drill string to the bit.

SUMMARY OF THE INVENTION

In one aspect the invention provides a multi-ram drill rig comprising:

- a drill tower;
- a drill head capable of applying torque to a drill bit, the drill head supported on the drill tower for linear motion along the drill tower;
- a travelling sheave trolley supported on the drill tower for motion along the drill tower and coupled to the drill head wherein a force applied in one direction to the travelling sheave trolley is transferred as a force acting in an opposite direction to the drill head; and,
- a plurality of rams coupled between the tower and the travelling sheave trolley, the rams being selectively actuated to apply a selectively variable force symmetrically to the travelling sheave trolley in either direction along the drill tower, wherein the selectively variable force is transferred by the travelling sheave trolley to the drill head to apply hold back and pull down to a drill bit coupled to the drill head.

In one embodiment the plurality of rams is capable of being actuated and coupled to the travelling sheave trolley to progressively increase by one the number of rams applying force to the travelling sheave trolley.

The rams may be coupled at one end to an upper end of the drill tower and at an opposite end to the travelling sheave trolley.

The travelling sheave trolley and the drill head may be disposed in separate parallel planes juxtaposed one behind the other.

The travelling sheave trolley may be provided with two sets of sheaves and two sets of ropes wherein a first set of ropes is attached at one end to an upper end of the drill tower, extend about the first set of sheaves and coupled at an opposite end to an upper end of the drill head; and, a second set of ropes is attached at one end to a lower end of the drill tower, extend about the second set of sheaves and is coupled at an opposite end to a lower end of the drill head.

The travelling sheave trolley and the rams may be arranged so that force applied by the rams when the rams extend is transmitted as hold back to the drill bit, and force applied by the rams when the rams retract is transmitted as pull down to the drill bit.

The travelling sheave trolley may be coupled to the drill head in a manner wherein motion of the travelling sheave trolley for a first distance caused by retraction or extension of the rams produces motion of twice the distance to the drill head.

The multi-ram drill rig may comprise a coupling system for selectively coupling rams to the travelling sheave trolley.

In one embodiment the plurality of rams comprises at least one primary ram operable to apply force to the travelling sheave trolley at a location along a longitudinal centre line of the trolley. Moreover the plurality of rams may comprise a single primary ram, and an even number of secondary rams, wherein the secondary rams are arranged in pairs, the rams in each pair symmetrically disposed about the primary ram.

In an alternate embodiment the plurality of rams comprises two primary rams continuously operable to provide hold back and pull down to a drill bit. In this embodiment the plurality of rams comprise an odd number of secondary rams arranged symmetrically about or between the primary rams wherein a first of the secondary rams is located midway between the primary rams.

The multi-ram drill rig may comprise a power pack capable of providing a maximum power output of about 400 hp to 500 hp and drilling to a depth of up to at least 2000 m.

In a second aspect the invention provides a method of drilling a hole comprising:

- providing a drill tower;
- supporting a drill head capable of applying torque to a drill bit, and a travelling sheave trolley, on the drill tower in a manner wherein both the drill head and the trolley are enabled to move linearly along the drill tower;
- coupling the trolley to the drill head in a manner wherein motion of the trolley in one direction causes motion of the drill head in an opposite direction;
- selectively actuating one or more of a plurality of rams to apply progressively increasing force symmetrically to the travelling sheave trolley.

The one or more rams are selectively actuated to increase by one the number of rams applying force to the travelling sheave trolley.

BRIEF DESCRIPTION OF THE DRAWINGS

Embodiments of the present invention will now be described in detail with reference to the accompanying drawings in which.

DETAILED DESCRIPTION OF PREFERRED EMBODIMENTS

An embodiment of the present invention provides a drill rig having a plurality of rams that can be selectively actuated to progressively increase the number of rams applying hold back and pull down to a drill head and associated drill bit rotated by the drill head in a manner where force is applied in balanced or symmetrical manner. For example in one embodiment the drill rig may comprise three rams which can apply hold back and pull down to a drill bit coupled to a drill head. The rams can be progressively actuated so that initially one ram is activated, then two rams, and then all three. The rams are arranged so that when they are progressively actuated, the force of the rams is applied in a balanced or symmetrical manner. This is facilitated by the use of a travelling sheave trolley which is connected between the rams and the drill head. The trolley and the drill head are coupled together in a manner so that movement of the travelling sheave trolley in one direction causes movement of the drill head in an opposite direction. The rams are capable of being actuated and coupled to the travelling sheave trolley to progressively increase by one the number of rams applying force to the travelling sheave trolley. The force applied by the rams is balanced or symmetrical in that the net force is applied evenly along or about a centre line of trave of the trolley thereby avoiding the generation of a moment or torque on the trolley. The coupling between the travelling sheave trolley and the drill head forms in effect a continuous force transfer loop where force applied to the travelling sheave trolley in one direction is transferred to and applied to the drill head in an opposite direction. Further, the force of the weight of the drill head is transferred to the travelling sheave trolley and subsequently onto the rams. The travelling sheave trolley is provided with first and second sets of sheaves about which respective cables or ropes extend. Due to the arrangement of the rams the load applied to each of the ropes extending about the first set of sheaves is identical. Similarly, the load applied to each of the ropes extending about the second set of sheaves is the same. Although the load applied to the ropes extending about the first sheaves will not the same as the load on the ropes extending about the second sheaves unless there is the same number of ropes about the respective sets of sheaves.

Figure 1:
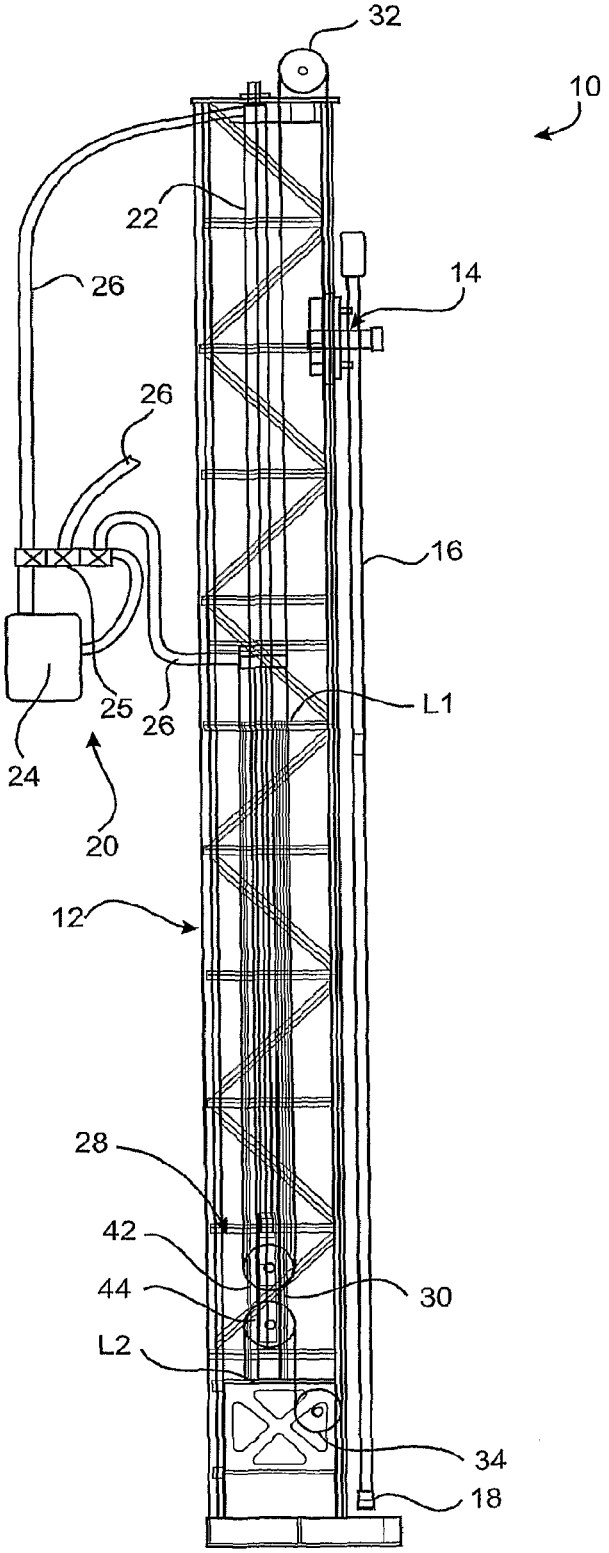
FIG. 1 is a side view of a first embodiment of a multi-ram drill rig in accordance with the present invention.

FIG. 1 depicts a first embodiment of a multi-ram drill rig 10. The drill rig 10 comprises a drill tower 12 and a drill head 14 that is able to travel linearly up and down the tower 12. The drill head 14 provides torque to a drill string 16 attached to the drill head 14 and thus to a drill bit 18 coupled to a distal end of the drill string 16. The drill head 14 is traversed along the tower 12 by a hydraulic system 20 which incorporates a plurality of rams 22*a*, 22*b* and 22*c* (hereinafter referred to in general as "rams 22"). The rams 22 provide hold back and pull down for the drill bit 18 via the drill head 14. The hydraulic system 20 comprises a supply of pressurised hydraulic fluid 24 which in itself may comprise for example a combination of a hydraulic motor and hydraulic oil storage tank, together with hydraulic valves 25 and hoses 26 that couple the rams 22 to the supply 24.

The rams 22 are selectively operable to enable the hold back and pull down applied to the drill bit to be selectively varied. Moreover the rams are selectively operated to progressively increase by one the number of rams that can apply hold back and pull down to the drill bit 18, and consequently enable drilling to progressively greater hole depths. Thus for example a first of the rams 22*a* is selected to operate when drilling to a first depth, then the rams 22*b* and 22*c* are selected to operate when drilling to a second greater depth; and finally all three rams 22*a*, 22*b* and 22*c* are selected to operate when drilling to a third greater depth.

The hold back and pull down is applied to the drill head 14/drill bit 18 via a sheave system 28. The sheave system 28 comprises a travelling sheave trolley 30, top idlers 32 and bottom idlers 34. The top and bottom idlers 32 and 34 rotate about axles that are linearly fixed at opposite ends of the tower 12. The sheave trolley 30 is selectively coupled to the rams 22 and travels linearly of the tower 12 along a guide structure (not shown). The sheave system 28 is arranged so that force applied by extension of the hydraulic rams 22 coupled to the trolley 30 is transmitted as hold back to the drill bit 18 whereas force applied by retraction of the rams 22 is transmitted as hold down to the drill bit 18.

Figure 2:
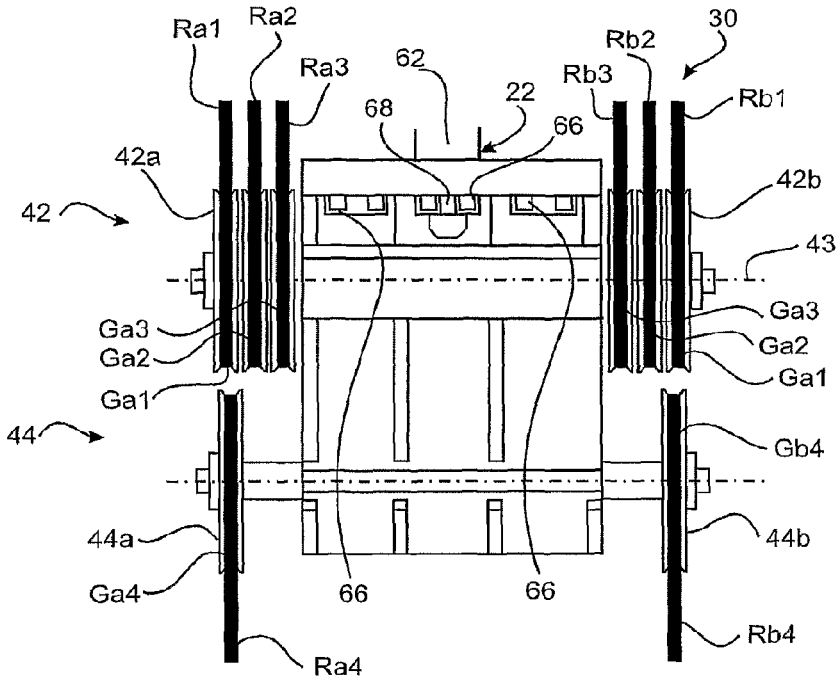
FIG. 2 is schematic representation of a travelling sheave trolley incorporated in the drill rig.
Figure 3:
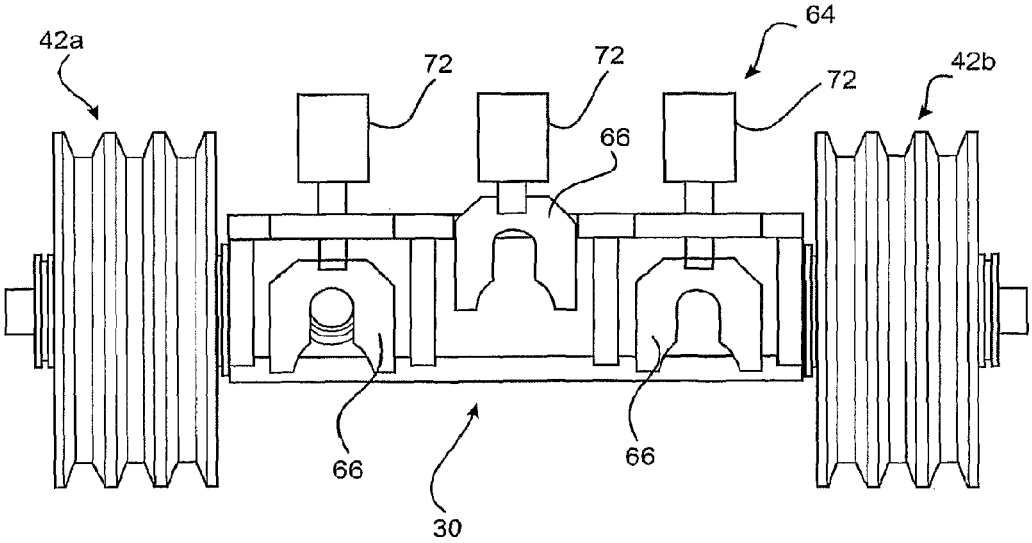
FIG. 3 is a view of section A-A of the trolley shown in FIG. 3.
Figure 4:
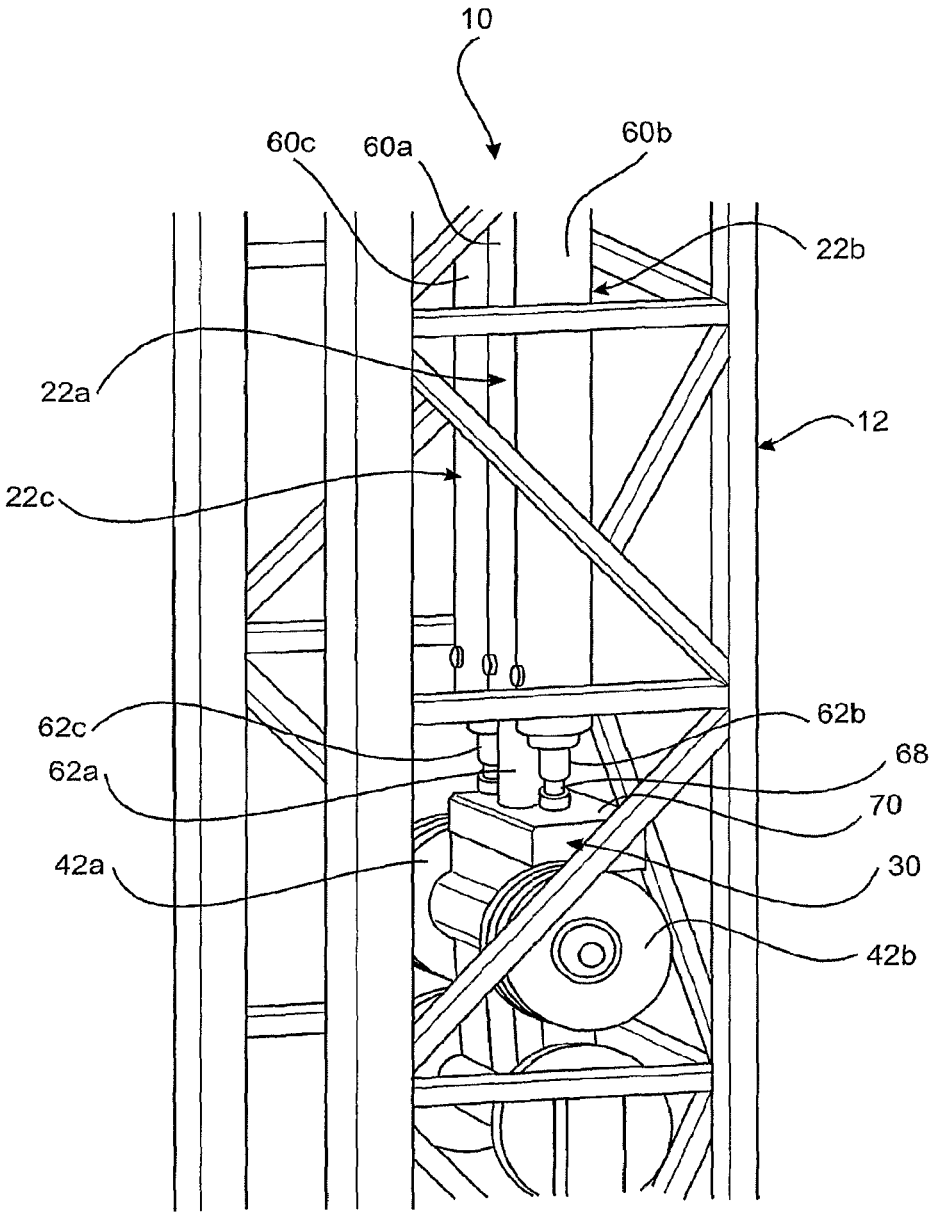
FIG. 4 is a enlarged view of a portion of the drill rig illustrating the coupling of rams to the trolley.

With particular reference to FIGS. 2-4, the travelling sheave trolley 30 comprises two sets of sheaves 42 and 44. The first set of sheaves 42 comprises sheaves 42*a* and 42*b* disposed on opposite sides of the sheave trolley 30 and rotatable about a common axis 43. Sheaves 42*a* and 42*b* are provided with grooves Ga1, Ga2 and Ga3; and, Gb1, Gb2 and Gb3, respectively. The second set of sheaves 44 comprises two sheaves 44*a* and 44*b* which, when the drill tower is in the upright position, are located below the sheaves 42 with one on each side of the travelling sheave trolley 30. The sheaves 44 are mounted for rotation about a common axis 45 which is parallel to the axis 43. Sheaves 44*a* and 44*b* are provided with respective single grooves Ga4 and Gb4.

A first set of ropes Ra1, Ra2, Ra3, Rb1, Rb2 and Rb3 (hereinafter referred to in general as "first ropes R1-3") extend about the sheaves 42 and seat in grooves Ga1, Ga2 Ga3, Gb1, Gb2 and Gb3 respectively. A second set of ropes Ra4 and Rb4 (hereinafter referred to in general as "second ropes R4") extend about sheaves 44 and seat in grooves Ga4 and Gb4 respectively.

One end of each of the first ropes R1-3 is coupled to the drill tower 12 at a location L1 intermediate the length of the tower 12 (see FIG. 1). The first ropes R1-3 then extend about respective sheaves 42 and turn upwardly and yop idlers 32 and then connect to an upper portion of the drill head 14. One end of each of the second ropes R4 is connected to a lower region L2 of the drill tower, extend about respective sheaves 44, then extend downwardly and turn about bottom idlers 34 located below the lower region L2 and then extend upwardly to connect to the drill head 14. As a result of this coupling it will be apparent that a downward motion of the travelling sheave trolley 30 will cause a corresponding upward motion of the drill head 14, and an upward motion of the travelling sheave trolley will result in a downward motion of the drill head 14. Accordingly force applied in a downward direction to the trolley 30 is transferred and applied as an upward force (hold back) to the drill head 14 while an upward directed force applied to the trolley 30 is transferred and applied as a downward force (pull down) to the drill head 14.

The trolley 30 and the drill head 14 move linearly in respective planes which are mutually parallel to each other and parallel to the length of the drill tower 12 but are located one behind the other. Further, the rams 22 are located in the same plane containing the trolley 30.

The rams 22 have a corresponding cylinder 60 and piston 62. Each ram 22, and more particularly, its corresponding cylinder 60 is coupled at one end to the upper end of the tower 12. The pistons 62 of each ram 22 is selectively coupled by a coupling system 64 to the trolley 30 (see FIGS. 2-4). The coupling system 64 comprises a plurality of locking keys 66 that can be selectively moved to engage and disengage a respective piston 62. Each piston 62 is formed with a reduced diameter neck 68 that can be extended into a corresponding hole 70 formed in the trolley 30. A lock and key 66 is provided in each hole and is able to move laterally by operating a hydraulic cylinder 72 so as to selectively engage and disengage the neck 68.

Rams 22 that are not engaged with the trolley 30 are fed with pilot pressure to hold the corresponding pistons 62 in a retracted condition. When it is required to engage a ram 22 with the trolley 30 to apply greater hold back and pull down, a hydraulic valve 25 in the hydraulic system is opened to enable the corresponding piston 62 to extend from its cylinder 60 to a position where the neck 68 is received by a respective hole 70 in the trolley 30 with the neck 68 located in a position where it can be engaged by a lock and key 66. The cylinder 72 operating the locking key 66 is then actuated to move the locking key to a position where it engages the neck 68 and thereby engages the corresponding ram to the trolley 30. Pilot pressure is applied to the cylinder 72 to keep the lock and key 66 in position. The ram may then be operated in the normal manner to apply force to the trolley 30 which is transferred as hold back or pull down to the drill head 14 and thus a drill bit 18 coupled to the drill head.

Figures 5, 6, 7:
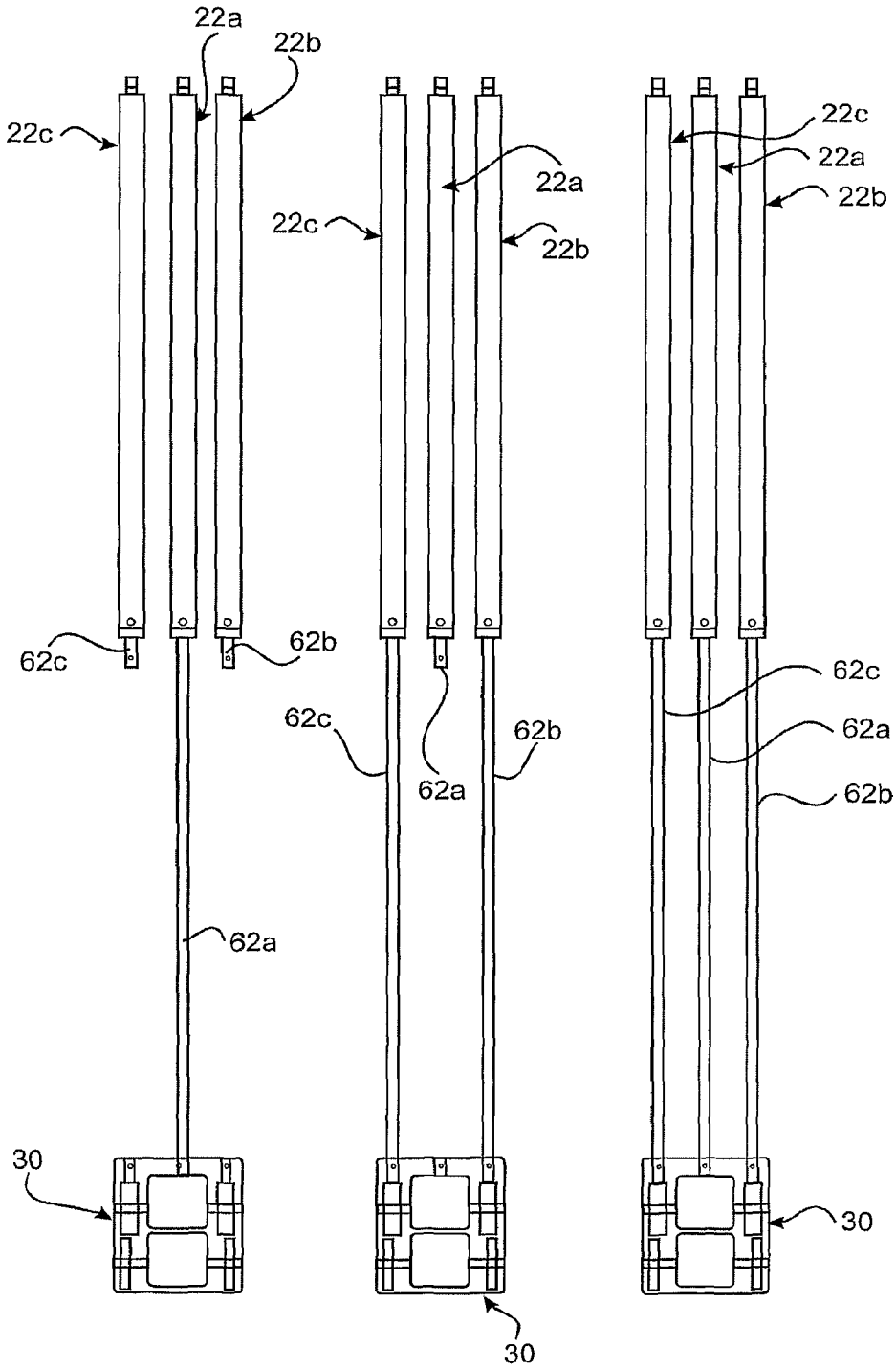
FIG. 5 is a front view of a first configuration of rams and a sheave system incorporated in the drill rig.
FIG. 6 is a front view of a second configuration of rams and a sheave system incorporated in the drill rig.
FIG. 7 is a front view of a third configuration of rams and a sheave system incorporated in the drill rig; and, FIG. 8 is a representation of a second embodiment of the multi-ram drill rig.

FIGS. 5-7 depict how the rams 22 are selectively operated to progressively or selectively vary the hold back and pull down applied to the drill bit 18.

The drill rig 10 in this embodiment comprises three rams 22*a*, 22*b* and 22*c*. Assume that it is required to drill a hole to a depth of say 2000 m. In order to drill a hole of this depth, initially a first of the hydraulic rams 22*a* supplied with pressurised hydraulic fluid via the hydraulic system 20. The piston 62*a* of ram 22*a* extends from its cylinder 60*a* and eventually the neck 68 enters a corresponding hole 70 in the trolley 30. The cylinder 72 is actuated to move the locking key 66 to a position here it engages about the neck 68 to couple the ram 22*a* to the trolley 30. Initially as the hole is being drilled, only the ram 22*a* supplies the required hold back and pull down for the bit 18. The net force applied by the ram 22*a* acts in a balanced or symmetrical manner on the trolley 30 as the force applied by ram is along a centre line of trolley 30. No moment or torque is generated by the ram 22*a* on the trolley 30.

As the hole depth increases the total weight of the drill string 16 increases. Therefore greater hold back force is required to control the weight applied to the bit 18. Thus for example once the hole depth exceeds 500 m, two of the rams, namely rams 22*b* and 22*c* are coupled to the trolley 30 in the same manner as described before in relation to ram 22*a*; and, the ram 22*a* is decoupled from the trolley 30 by retracting the corresponding locking key 66. The piston 62*a* is retracted and held in a retracted condition by application of pilot pressure.

Now the two rams 22*b* and 22*c* provide hold back and pull down to the drill bit 18. This relationship is shown in FIG. 6 where the respective piston rods 62*b* and 62*c* of the rams 22*b* and 22*c* respectively are coupled to the trolley 30. The net force applied by the rams 22*b* and 22*c* acts in a balanced or symmetrical manner on the trolley 30 as both rams provide the same force in the direction and same and at points even spaced about the centre line of trolley 30. No moment or torque is generated by the rams on the trolley 30.

The two rams 22*b* and 22*c* are able to provide sufficient hold back and pull down for the drill rig 10 to continue drilling to a further depth for example 1000m after which all three rams 22*a*, 22*b* and 22*c* are selected to operate as shown in FIG. 7 to provide hold back and pull down. In this arrangement, each of the rams 22 is coupled with the hydraulic motor 24 and each have their respective piston rods coupled to the trolley 30. Again the net force applied is balanced or symmetrical.

Each of the ropes R1-3 carries the same load as each other, as do ropes R4. However as there is a different number of ropes R1-3 (six ropes) to the number of ropes R4 (two ropes) and load carried by each of ropes R1-3 is different to that carries by each of ropes R4.

Thus, in summary it can been seen that embodiments of the drill rig enable the progressive operation of rams to control or otherwise selectively vary the hold back and pull down that can be applied to a drill bit 18. The drill rig and in particular the hydraulic system is capable of operating the rams provide hold back and pull down in a symmetrical or balanced manner as the number of rams coupled to the drill head progressively increases.

Figure 8:
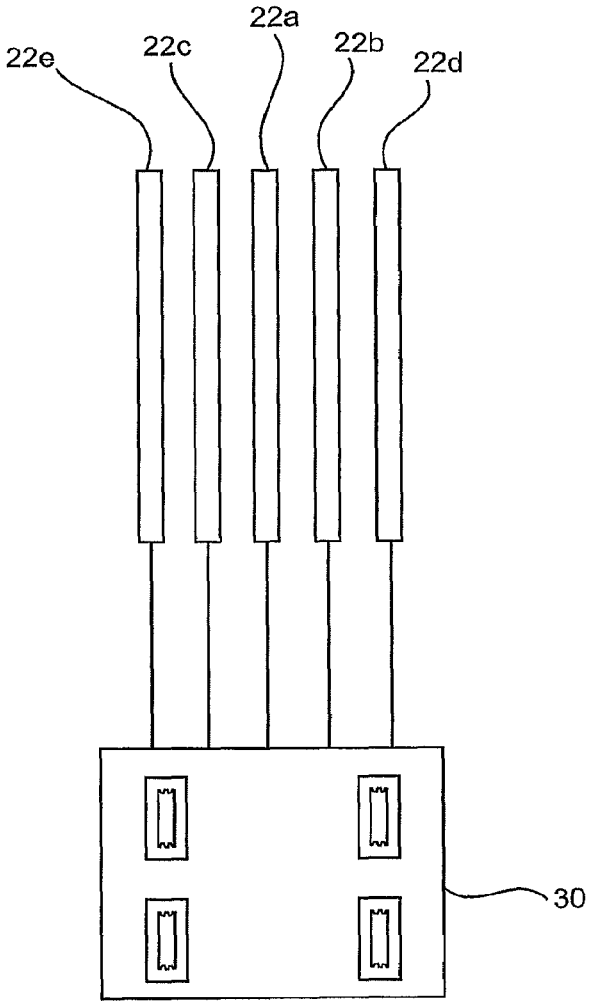

In the embodiment shown in FIGS. 5-7, the ram 22*a*, namely the central ram may be considered as a single primary ram. In this embodiment the plurality of rams comprises the single primary ram and an even number (2) secondary rams, namely rams 22*b* and 22*c*. The secondary rams are arranged in symmetrical pairs disposed about the primary ram 22*a*. However, embodiments of the invention are not limited to rigs comprising only three rams or only a single primary ram. For example, FIG. 8 depicts an embodiment where the hydraulic system comprises five rams 22*a*-22*e*. In this embodiment the ram 22*a* is considered as a single primary ram. Rams 22*b* and 22*c* may be considered as forming a first pair of secondary rams and the rams 22*d* and 22*e* may be considered as a second pair of secondary rams. The table below illustrates one possible operation scenario for the hydraulic system where the rams 22*a*-22*e* are progressively switched and/or operated to increase hold back and pull down.

TABLE 1

| Total Hold Back Force | Ram 22e | Ram 22c | Ram 22a | Ram 22b | Ram 22d |
|---|---|---|---|---|---|
| 1F | D | D | C | D | D |
| 2F | D | C | D | C | D |
| 3F | D | C | C | C | D |
| 4F | C | C | D | C | C |
| 5F | C | C | C | C | C |

In the above table, the letter "C" indicates that a ram is coupled with the hydraulic system and operable to provide hold back. The letter "D" indicates that the ram is disconnected and therefore unable to provide hold back. The column "Total Hold Back Force" provides an indication of the maximum hold back force applicable by the hydraulic system as a whole in terms of unit of force "F". As is readily apparent, as the number of rams 22 coupled into the hydraulic system sequentially increases so does the hold back force from the force of 1 F when only the single ram 22*a* is coupled to a maximum force of 5 F when all five rams 22*a*-22*c* are connected. The five ram embodiment shown in FIG. 8 may be used to drill holes deeper than the three ram embodiment shown in FIGS. 5-7. For example a rig comprising the rams of FIG. 8 may drill to say a depth of 4000 m. When the rams of this rig are operated in accordance with the sequence of Table 1, initially the hole is drilled utilising only the single ram 22*c* for speed and economy with the number of rams activated sequentially increasing to 2, 3, 4 and 5 with increasing drilling depth.

Table 2 below describes an alternate operating sequence for the rams 22*a*-22*e* shown in FIG. 5. In this operational sequence, the rams 22*b* and 22*c* are considered to be a pair of primary rams which are continuously operated to provide hold back and pull down. The rams 22*a*, 22*d* and 22*e* are considered as secondary rams. Thus in this arrangement, there is an even number of primary rams and an odd number of secondary rams. The secondary rams 22*a*, 22*d* and 22*e* are arranged symmetrically about or between the primary rams 22*b* and 22*c*, with the secondary ram 22*a* located midway between the primary rams 22*b* and 22*c*. In this arrangement, the minimum hold back initially provided by the drill rig is 2 F as both the primary rams 22*b* and 22*c* are operated simultaneously to provide the minimum hold back and pull down. To increase the hold back as drilling depth increases, next the secondary ram 22*a* may be coupled into the system to provide the hold back of 3 F. Thereafter, the secondary ram 22*a* can be disconnected and the outer two secondary rams 22*d* and 22*e* connected to provide total hold back of 4 F. Finally, maximum hold back of 5 F is available when all of the secondary rams 22*a*, 22*d*, and 22*e* are connected.

TABLE 2

| Total Hold Back Force | Ram 22e | Ram 22c | Ram 22a | Ram 22b | Ram 22d |
|---|---|---|---|---|---|
| 2F | D | C | D | C | D |
| 3F | D | C | C | C | D |
| 4F | C | C | D | C | C |
| 5F | C | C | C | C | C |

As a consequence of this arrangement a smaller power pack can be used for a deep hole drill rig than for a conventional deep hole rig. Thus a rig having a power pack of say no more than about 400 hp to 500 hp can now be used to drill to at least 1000 m and moreover to the same depth as a rig having a 2500 hp power pack. This arises because for an initial drilling depth of say 800 m less than 500 hp and typically only about 400 hp is required to provide the hold back and pull down. As hole depth increases and further rams are selectively operated the same power pack is still able to provide the required hydraulic pressure to provide the hold back and pull down needed to drill to the depth of the 2500 hp rig, although the feed speed i.e. the speed at which the drill head is moved up and down the tower reduces. In practice however this is of little consequence as for safety and equipment maintenance reasons feed speed is ordinarily reduced.

Now that embodiments of the present invention have been described in detail it will be apparent to those skilled in the relevant arts that numerous modifications and variations may be made without departing from the basic inventive concepts. For example, in the described embodiment, disconnected rams 22 are depicted as having their corresponding piston rods physically disconnected from the trolley 30. However in an alternate embodiment, the piston rods may be always physically connected with the coupling block 30, but the hydraulics for a particular disconnected ram switched to a recirculating circuit that enables hydraulic fluid within the corresponding cylinder to simply flow from one end to the other end of the cylinder. Further, any convenient arrangement may be used to physically couple the piston rods to the coupling block 30. This includes the use of mechanical fasteners such as bolts or pins; or may comprise electrically or pneumatically actuated pins or wedges. Further, the drill rig 10 may be part of a mobile drill rig carried on a prime mover or alternately an in situ rig that is erected at the place of drilling. All such modifications and variations are deemed to be within the scope of the present invention the nature of which is to be determined from the above description.

The invention claimed is:

1. A multi-ram drill rig comprising:

a drill tower;

a drill head capable of applying torque to a drill bit, the drill head supported on the drill tower for linear motion along the drill tower;

a travelling sheave trolley supported on the drill tower for linear motion along the drill tower and coupled to the drill head wherein a force applied in one direction to the travelling sheave trolley is transferred as a force acting in an opposite direction to the drill head; and, a plurality of hydraulic rams capable of applying a selectively variable force symmetrically to the travelling sheave trolley in either direction along the drill tower, wherein the selectively variable force is transferred by the travelling sheave trolley to the drill head to apply hold back and pull down to a drill bit coupled to the drill head.

2. The multi-ram drill rig according to claim 1 wherein the plurality of rams is capable of being selectively actuated and coupled to the travelling sheave trolley to apply the selectively variable force.

3. The multi-ram drill rig according to claim 2 wherein the plurality of rams is capable of progressively increasing by one the number of rams applying force to the travelling sheave trolley.

4. The multi-ram drill rig according to claim 2 wherein the travelling sheave trolley is provided with two sets of sheaves and two sets of ropes wherein a first set of ropes is attached at one end to an upper end of the drill tower, extend about the first set of sheaves and coupled at an opposite end to an upper end of the drill head; and, a second set of ropes is attached at one end to a lower end of the drill tower, extend about the second set of sheaves and is coupled at an opposite end to a lower end of the drill head.

5. The multi-ram drill rig according to claim 2 wherein the travelling sheave trolley and the rams are arranged so that force applied by the rams when the rams extend is transmitted as hold back to the drill bit, and force applied by the rams when the rams retract is transmitted as pull down to the drill bit.

6. The multi-ram drill rig according to claim 2 wherein travelling sheave trolley is coupled to the drill head in a manner wherein motion of the travelling sheave trolley for a first distance caused by retraction or extension of the rams produces motion of twice the distance to the drill head.

7. The multi-ram drill rig according to claim 2 comprising a coupling system for selectively coupling rams to the travelling sheave trolley.

8. The multi-ram drill rig according to claim 1 wherein the each ram is coupled at one end to an upper end of the drill tower and at an opposite end to the travelling sheave trolley, and the plurality of rams is capable of being selectively activated to apply the selectively variable force while coupled at both ends.

9. The multi-ram drill rig according to claim 8 wherein each ram is associated with a switching mechanism to switch a hydraulic circuit of a deactivated ram to a recirculating circuit so that a corresponding force is not applied by the deactivated ram to the travelling sheave trolley.

10. The multi-ram drill rig according to claim 8 wherein the plurality of rams is capable of progressively increasing by one the number of rams applying force to the travelling sheave trolley.

11. The multi-ram drill rig according to claim 1 wherein the travelling sheave trolley and the drill head are disposed in separate parallel planes juxtaposed one behind the other.

12. The multi-ram drill rig according to claim 1 wherein the plurality of rams comprises at least one primary rams operable to apply force to the travelling sheave trolley at a location along a longitudinal center line of the trolley.

13. The multi-ram drill rig according to claim 12 wherein the plurality of rams comprises a single primary ram, and an even number of secondary rams, wherein the secondary rams are arranged in pairs, the rams in each pair symmetrically disposed about the primary ram.

14. The multi-ram drill rig according to claim 1 wherein the plurality of rams comprises two primary rams continuously operable to provide hold back and pull down to a drill bit.

15. The multi-ram drill rig according to claim 14 wherein the plurality of rams comprise an odd number of secondary rams arranged symmetrically about or between the primary rams wherein a first of the secondary rams is located midway between the primary rams.

16. The multi-ram drill rig according to claim 1 comprising a power pack for providing hydraulic pressure for the plurality of rams to apply hold back and pull down force, the power pack capable of providing a maximum power output of about 400 hp to 500 hp and drilling to a depth of up to at least 1000 m.

17. A method of drilling a hole comprising:

providing a drill tower;

supporting a drill head capable of applying torque to a drill bit, and a travelling sheave trolley, on the drill tower in a manner wherein both the drill head and the trolley are enabled to move linearly along the drill tower;

coupling the trolley to the drill head in a manner wherein motion of the trolley in one direction causes motion of the drill head in an opposite direction;

selectively activating one or more of a plurality of rams to apply a selectively variable force symmetrically to the travelling sheave trolley.

18. The method of claim 17 wherein the step of selectively activating one or more of the plurality of rams comprises selectively actuating and coupling one or more of the plurality of rams to the travelling sheave trolley.

19. The method according to claim 18 wherein the one or more rams are selectively actuated to progressively increase the number of rams applying force to the travelling sheave trolley.

20. The method of claim 17 wherein each ram is coupled at one end to an upper end of the drill tower and at an opposite end to the travelling sheave trolley, and the step of selectively activating one or more of the plurality of rams is performed while each ram is coupled at both ends.

* * * * *